US009381130B2

(12) United States Patent
Keith-Lucas et al.

(10) Patent No.: US 9,381,130 B2
(45) Date of Patent: Jul. 5, 2016

(54) SURGICAL FOOT SUPPORT WITH TIGHTENER SYSTEM

(75) Inventors: Darwin Keith-Lucas, Arlington, MA (US); Orlando Soto, Salem, MA (US); David E. Chella, Brighton, MA (US)

(73) Assignee: Allen Medical Systems, Inc., Batesville, IN (US)

( * ) Notice: Subject to any disclaimer, the term of this patent is extended or adjusted under 35 U.S.C. 154(b) by 532 days.

(21) Appl. No.: 13/151,627

(22) Filed: Jun. 2, 2011

(65) Prior Publication Data

US 2012/0305006 A1 Dec. 6, 2012

(51) Int. Cl.
*A61G 13/12* (2006.01)

(52) U.S. Cl.
CPC ..... *A61G 13/125* (2013.01)

(58) Field of Classification Search
USPC ..... 602/20, 23–29, 692, 65–66; 128/845–846, 876, 882, 869; 5/650, 5/621, 648, 611, 623, 624; 36/50.2, 89, 36/119.1, 118.2, 118.3
See application file for complete search history.

(56) References Cited

U.S. PATENT DOCUMENTS

| | | | | |
|---|---|---|---|---|
| 542,390 | A | | 7/1895 | Linn |
| 2,267,924 | A | | 12/1941 | Johnston |
| 2,609,261 | A | | 9/1952 | Parker |
| 2,630,288 | A | | 3/1953 | Eubanks, Sr. |
| 2,732,269 | A | | 1/1956 | Astroff |
| 2,801,142 | A | | 7/1957 | Adams |
| 2,910,061 | A | | 10/1959 | Rabjohn |
| 3,226,105 | A | | 12/1965 | Weickgenannt et al. |
| 3,540,719 | A | | 11/1970 | Romney et al. |
| 3,762,514 | A | | 10/1973 | Freitag |
| 3,845,945 | A | | 11/1974 | Lawley et al. |
| 3,982,742 | A | | 9/1976 | Ford |
| 4,054,282 | A | | 10/1977 | Hamer |
| 4,160,332 | A | * | 7/1979 | Salomon ..... 36/118.1 |
| 4,163,536 | A | | 8/1979 | Heller et al. |
| 4,180,254 | A | | 12/1979 | Lee et al. |
| 4,185,813 | A | | 1/1980 | Spann |
| 4,221,370 | A | | 9/1980 | Redwine |
| 4,252,306 | A | | 2/1981 | Johnson et al. |
| 4,323,060 | A | | 4/1982 | Pecheux |
| 4,367,869 | A | | 1/1983 | Dailey et al. |
| 4,373,709 | A | | 2/1983 | Whitt |
| 4,407,277 | A | | 10/1983 | Ellison |

(Continued)

FOREIGN PATENT DOCUMENTS

| | | |
|---|---|---|
| EP | 0213613 A2 | 3/1987 |
| EP | 0646334 A1 | 4/1995 |

(Continued)

OTHER PUBLICATIONS

"Peace of Mind? Piece of Cake!, Great Products . . . Great Prices" O.R. Direct Surgical Table Accessories, Fall 1999, (24 pages).

(Continued)

*Primary Examiner* — Ophelia A Hawthorne
(74) *Attorney, Agent, or Firm* — Barnes & Thornburg LLP

(57) ABSTRACT

A surgical boot includes a shell shaped to receive a patient's foot and a main strap assembly. The main strap assembly includes at least two straps that secure a patient's foot in the shell and that are pulled downwardly by a tensioner unit located behind the shell to tighten a patient's foot with the shell.

20 Claims, 11 Drawing Sheets

(56) References Cited

U.S. PATENT DOCUMENTS

| | | | | |
|---|---|---|---|---|
| 4,418,900 | A | 12/1983 | Ricke | |
| 4,426,071 | A | 1/1984 | Klevstad | |
| 4,428,571 | A | 1/1984 | Sugarman | |
| 4,443,005 | A | 4/1984 | Sugarman et al. | |
| 4,467,538 | A * | 8/1984 | Olivieri | 36/117.1 |
| 4,471,952 | A | 9/1984 | Spann | |
| 4,482,138 | A | 11/1984 | Spann | |
| 4,526,355 | A | 7/1985 | Moore et al. | |
| 4,545,573 | A | 10/1985 | Murphy | |
| 4,564,164 | A | 1/1986 | Allen et al. | |
| 4,564,180 | A | 1/1986 | Agee et al. | |
| 4,577,730 | A | 3/1986 | Porter | |
| 4,579,324 | A | 4/1986 | McConnell | |
| 4,620,698 | A | 11/1986 | Reed et al. | |
| 4,632,349 | A | 12/1986 | Anstey | |
| 4,681,309 | A | 7/1987 | Lechner | |
| 4,698,837 | A | 10/1987 | Van Steenburg | |
| 4,702,465 | A | 10/1987 | McConnell | |
| 4,724,626 | A * | 2/1988 | Baggio | 36/117.8 |
| 4,730,609 | A | 3/1988 | McConnell | |
| 4,732,145 | A | 3/1988 | Latham | |
| 4,766,892 | A | 8/1988 | Kreitman | |
| 4,782,827 | A | 11/1988 | Paratte | |
| 4,802,464 | A | 2/1989 | Deprez | |
| 4,807,618 | A | 2/1989 | Auchinleck et al. | |
| 4,809,687 | A | 3/1989 | Allen | |
| 4,827,496 | A | 5/1989 | Cheney | |
| 4,840,363 | A | 6/1989 | McConnell | |
| 4,886,258 | A | 12/1989 | Scott | |
| 4,893,419 | A * | 1/1990 | Arieh et al. | 36/118.1 |
| 4,898,491 | A | 2/1990 | Van Steenburg | |
| 4,909,264 | A | 3/1990 | Wadsworth, III et al. | |
| 4,913,413 | A | 4/1990 | Raab | |
| 4,940,218 | A | 7/1990 | Akcelrod | |
| 5,001,739 | A | 3/1991 | Fischer | |
| 5,010,900 | A | 4/1991 | Auchinleck et al. | |
| 5,020,525 | A | 6/1991 | Ewing et al. | |
| 5,027,799 | A | 7/1991 | Laico et al. | |
| 5,042,508 | A | 8/1991 | Richard | |
| 5,056,535 | A | 10/1991 | Bonnell | |
| 5,065,533 | A * | 11/1991 | Paris | A43B 5/048 36/118.1 |
| 5,097,847 | A | 3/1992 | Mikhail et al. | |
| 5,104,363 | A | 4/1992 | Shi | |
| 5,116,008 | A | 5/1992 | Allen | |
| 5,290,220 | A | 3/1994 | Guhl | |
| 5,291,903 | A | 3/1994 | Reeves | |
| 5,369,827 | A | 12/1994 | Parke et al. | |
| 5,410,769 | A | 5/1995 | Waterman | |
| 5,435,080 | A * | 7/1995 | Meiselman | A63C 10/08 280/14.21 |
| 5,462,551 | A | 10/1995 | Bailey et al. | |
| 5,472,412 | A | 12/1995 | Knoth | |
| 5,481,770 | A | 1/1996 | Ahlsten | |
| 5,514,143 | A | 5/1996 | Bonutti et al. | |
| 5,515,562 | A | 5/1996 | Miller et al. | |
| 5,560,577 | A | 10/1996 | Keselman | |
| 5,582,379 | A | 12/1996 | Keselman et al. | |
| 5,608,934 | A | 3/1997 | Torrie et al. | |
| 5,636,899 | A | 6/1997 | Schiff et al. | |
| 5,645,079 | A | 7/1997 | Zahiri et al. | |
| 5,738,675 | A | 4/1998 | Botimer | |
| 5,758,374 | A | 6/1998 | Ronci | |
| 5,799,349 | A | 9/1998 | Petersen | |
| 5,802,641 | A | 9/1998 | Van Steenburg | |
| 5,806,117 | A | 9/1998 | Gotfried | |
| 5,918,330 | A | 7/1999 | Navarro et al. | |
| 5,937,546 | A * | 8/1999 | Messmer | 36/89 |
| 5,961,085 | A | 10/1999 | Navarro et al. | |
| 6,058,534 | A | 5/2000 | Navarro et al. | |
| 6,108,841 | A | 8/2000 | Cameron et al. | |
| 6,195,820 | B1 | 3/2001 | Heimbrock et al. | |
| 6,263,531 | B1 | 7/2001 | Navarro et al. | |
| 6,289,537 | B1 | 9/2001 | Hopper et al. | |
| 6,289,558 | B1 | 9/2001 | Hammerslag | |
| 6,336,412 | B2 | 1/2002 | Heimbrock et al. | |
| 6,467,487 | B1 | 10/2002 | Rios | |
| 6,629,944 | B2 | 10/2003 | Smart | |
| 6,663,055 | B2 | 12/2003 | Boucher et al. | |
| 6,704,959 | B2 | 3/2004 | Schuerch | |
| 6,748,630 | B2 * | 6/2004 | Livingston | 24/68 SK |
| 6,811,541 | B2 | 11/2004 | Lambert | |
| 6,874,184 | B2 | 4/2005 | Chandler | |
| 7,210,252 | B2 * | 5/2007 | Morrow et al. | 36/118.2 |
| 7,243,654 | B2 | 7/2007 | Schuerch | |
| 7,316,040 | B2 | 1/2008 | Siccardi et al. | |
| 7,337,483 | B2 | 3/2008 | Boucher et al. | |
| 7,591,050 | B2 | 9/2009 | Hammerslag | |
| RE41,412 | E | 7/2010 | Van Steenburg | |
| 7,832,401 | B2 | 11/2010 | Torrie et al. | |
| 7,870,624 | B1 | 1/2011 | Winston | |
| 2004/0133979 | A1 | 7/2004 | Newkirk | |
| 2005/0160533 | A1 | 7/2005 | Boucher et al. | |
| 2006/0225743 | A1 | 10/2006 | Schuerch | |
| 2007/0265635 | A1 | 11/2007 | Torrie et al. | |
| 2009/0235457 | A1 | 9/2009 | Harvey | |
| 2010/0242181 | A1 | 9/2010 | Bochner et al. | |
| 2011/0023893 | A1 | 2/2011 | Striggow et al. | |
| 2011/0197362 | A1 | 8/2011 | Chella et al. | |

FOREIGN PATENT DOCUMENTS

| | | | |
|---|---|---|---|
| EP | 2363100 | A1 | 9/2011 |
| WO | 2008/133970 | A1 | 11/2006 |

OTHER PUBLICATIONS

"Passionate About Positioning", Allen Medical Systems , (20 pages) 1998.

European Search Report Application Serial No. P68404.EP01/AF, completed Jun. 28, 2013, (6 pages).

* cited by examiner

SURGICAL FOOT SUPPORT WITH TIGHTENER SYSTEM

BACKGROUND

The present disclosure relates to a patient support apparatus for supporting a patient during surgery. More particularly, the present disclosure relates to a surgical boot for supporting a patient during surgery.

Often, when a patient is sedated for a surgery, the patient is supported by and secured to braces or supports coupled to a surgical table. Sometimes, unique supports are provided for a patient's extremities such as arm boards, leg supports, hand boards, stirrups, and boots.

Supports known in the art sometimes secure patients to resist patient movement. Such supports can sometimes allow excessive patient movement relative to the supports.

SUMMARY

A surgical boot has one or more of the features recited in the appended claims and/or the following features which, alone or in any combination, may comprise patentable subject matter:

A surgical boot is disclosed and includes a shell shaped to receive a patient's foot and a main strap assembly. The main strap assembly includes at least two straps that secure a patient's foot in the shell and that are pulled downwardly by a tensioner unit located behind the shell to tighten a patient's foot with the shell.

In some embodiments, the tensioner unit may include a ratchet and a toothed belt coupled to the at least two straps. The toothed belt may be advanced in a forward direction through the ratchet to pull the at least two straps of the main strap assembly. The ratchet may include an actuator lever operable by a caregiver to advance the toothed belt through the ratchet and a release lever configured to selectively release the toothed belt from the ratchet so that the toothed belt is free to move in a backward direction through the ratchet. The ratchet may include a ratchet pawl engaging the toothed belt to advanced the toothed belt in a forward direction and a keeper pawl configured to engage the toothed belt and block the toothed belt from moving in the backward direction.

The at least two straps may extend across an upwardly-facing channel formed by the shell and through a left side and a right side of the shell. The surgical boot may include a strap guide assembly configured to guide the at least two straps of the main strap assembly from left and right sides of the shell toward a heel end of the shell. The shell may include a sole and the strap guide assembly may be coupled to a bottom side of the sole.

It is contemplated that the shell may have a toe end and a heel end. The shell may include a sole, a calf support extending up from the sole near the heel end of the shell, and a rear guide beam situated behind the calf support and forming the heel end of the shell. The rear guide beam may be configured to guide the at least two straps from below the sole toward the calf support. The calf support may be formed to include a guide channel configured to receive and guide the at least two straps along the calf support.

The surgical boot may include a heel strap assembly configured to extend around the back side of a patient's foot over a patient's heel bone. The heel strap may have a first end coupled one of the at least two straps of the main strap assembly and a second end coupled to another of the at least two straps of the main strap assembly. The first end and the second end of the heel strap may be slidably coupled to independent ones of the at least two straps of the main strap assembly.

A surgical boot may include a shell, a main strap assembly, a heel strap, and a tensioner unit. The shell may be sized to receive a patient's foot and may include a sole and a calf support. The main strap assembly may be configured to extend over a patient's foot near a patient's lower leg. The heel strap assembly may have a first end coupled to the main strap assembly and a second end coupled to the main strap assembly. The heel strap assembly may be configured to extend around the back side of a patient's foot above a patient's heel bone. The tensioner unit may be coupled to the shell and may be configured to pull the main strap assembly toward the sole of the shell to tighten a patient's foot with the shell.

The main strap assembly may include a left strap and a right strap. The tensioner unit may include a ratchet and a toothed belt coupled to the left strap and the right strap. The left strap and the right strap may extend through the shell.

The first end and the second end of the heel strap assembly may be slidably coupled to the main strap assembly. In some embodiments, the surgical boot may include a receiver configured to couple the surgical boot to a surgical table.

A method of securing a patient's foot in a surgical boot may include the steps of placing a patient's foot in a channel formed by a shell of the surgical boot, guiding a first strap and a second strap across the patient's foot near a patient's ankle, coupling the first strap to the second strap, and operating a tensioner unit coupled to a back side of a calf support included in the shell. Operating the tensioner unit may be performed to pull the first strap and the second strap down through the shell so that a patient's foot is tightened with the shell.

In some embodiments of the method, the surgical boot may include a heel strap coupled at a first end to the first strap and at a second end to the second strap. The heel strap may be configured to extend around the back side of a patient's foot above the heel bone Additional features, which alone or in combination with any other feature(s), such as those listed above and those listed in the claims, may comprise patentable subject matter and will become apparent to those skilled in the art upon consideration of the following detailed description of various embodiments exemplifying the best mode of carrying out the embodiments as presently perceived.

BRIEF DESCRIPTION OF THE DRAWINGS

The detailed description particularly refers to the accompanying figures, in which.

DETAILED DESCRIPTION

Figure 1:
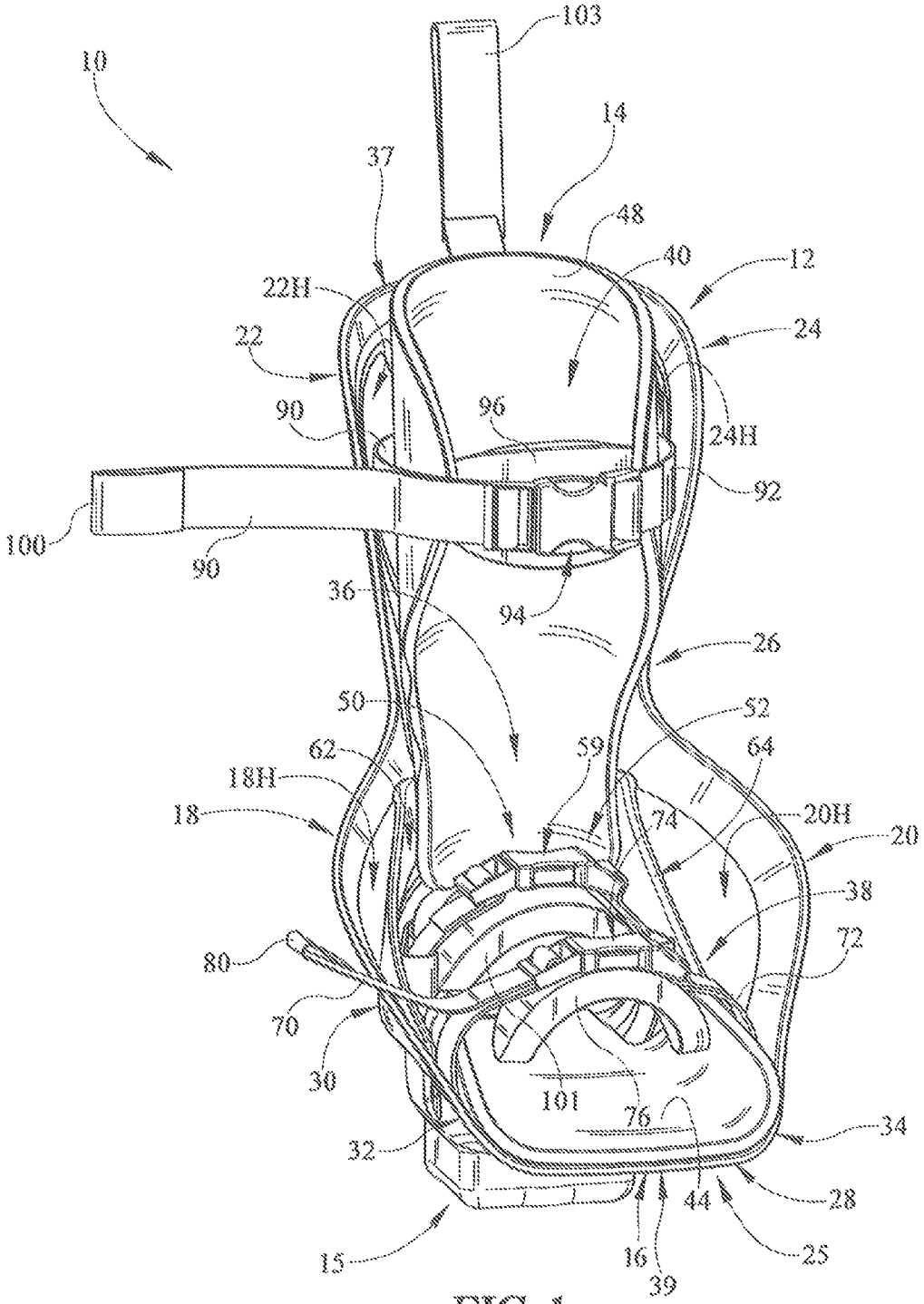
FIG. 1 is a front perspective view of a surgical boot including a shell sized to receive a patient's foot and formed to include handles for use by a caregiver, several straps for securing a patient's foot and lower leg to the shell as shown in FIG. 5, and a receiver coupled to the bottom of the shell for connecting the surgical boot to a surgical table as shown in FIG. 9.
Figure 5:
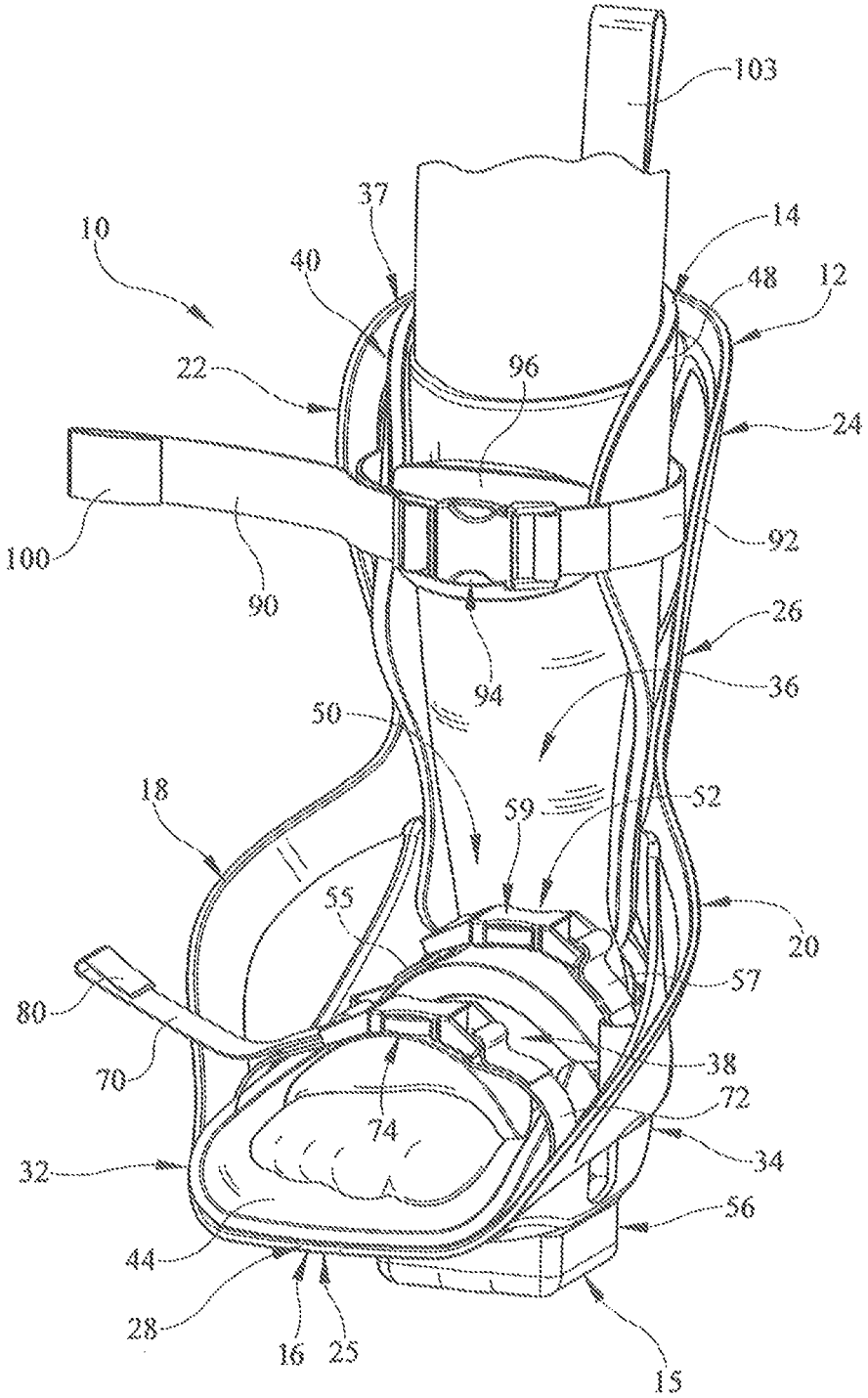
FIG. 5 is a front perspective view of the surgical boot of FIG. 4 after a patient's foot has been lowered into the channel formed by the shell showing the patient's foot secured to the shell by the toe strap assembly, the main strap assembly, and the calf strap assembly.
Figure 6:
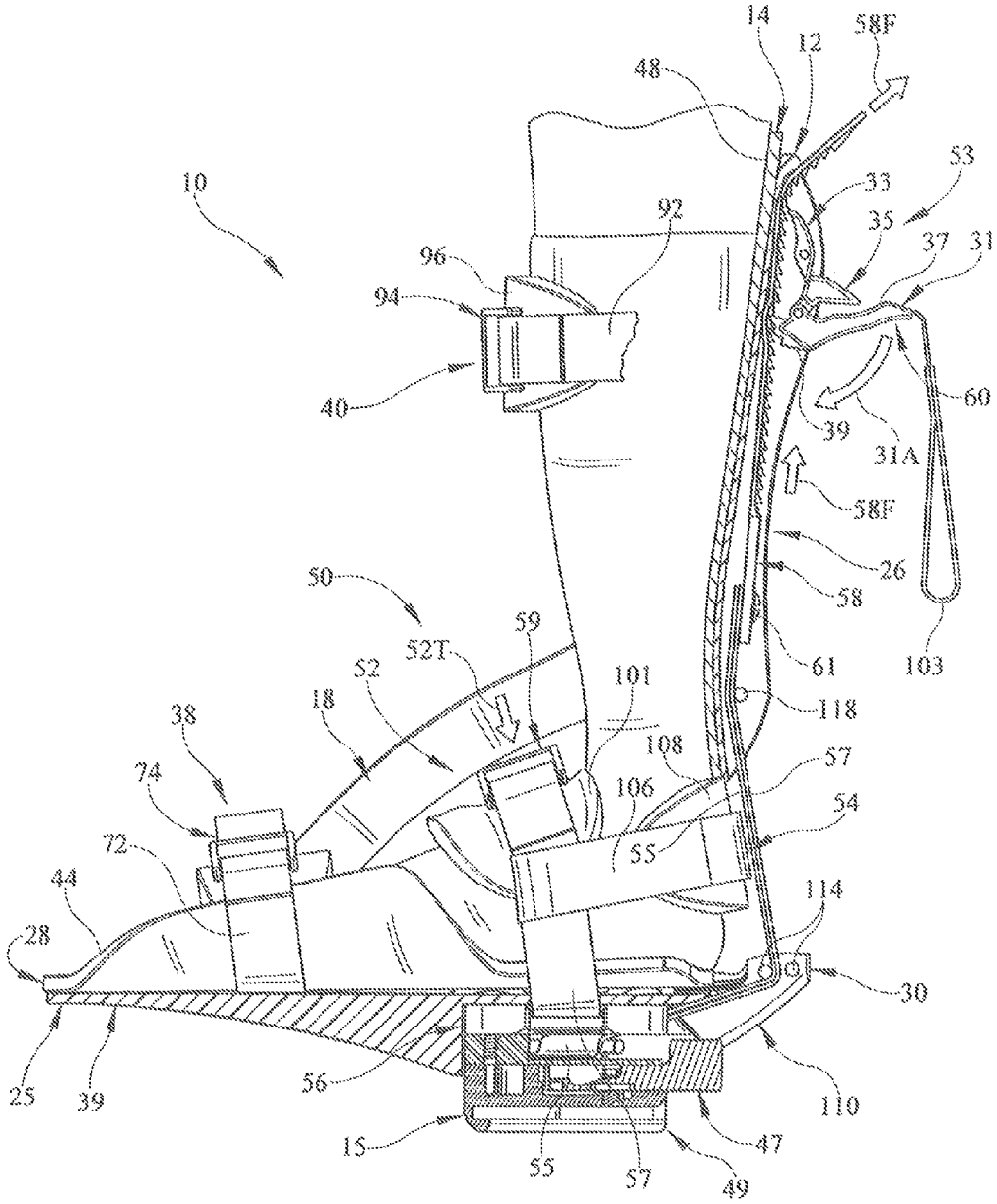
FIG. 6 is a partially cutaway side elevation view of the surgical boot of FIG. 5 showing the main strap assembly being pulled down toward the shell by the tensioner unit in response to a ratchet being operated by a caregiver.
Figure 9:
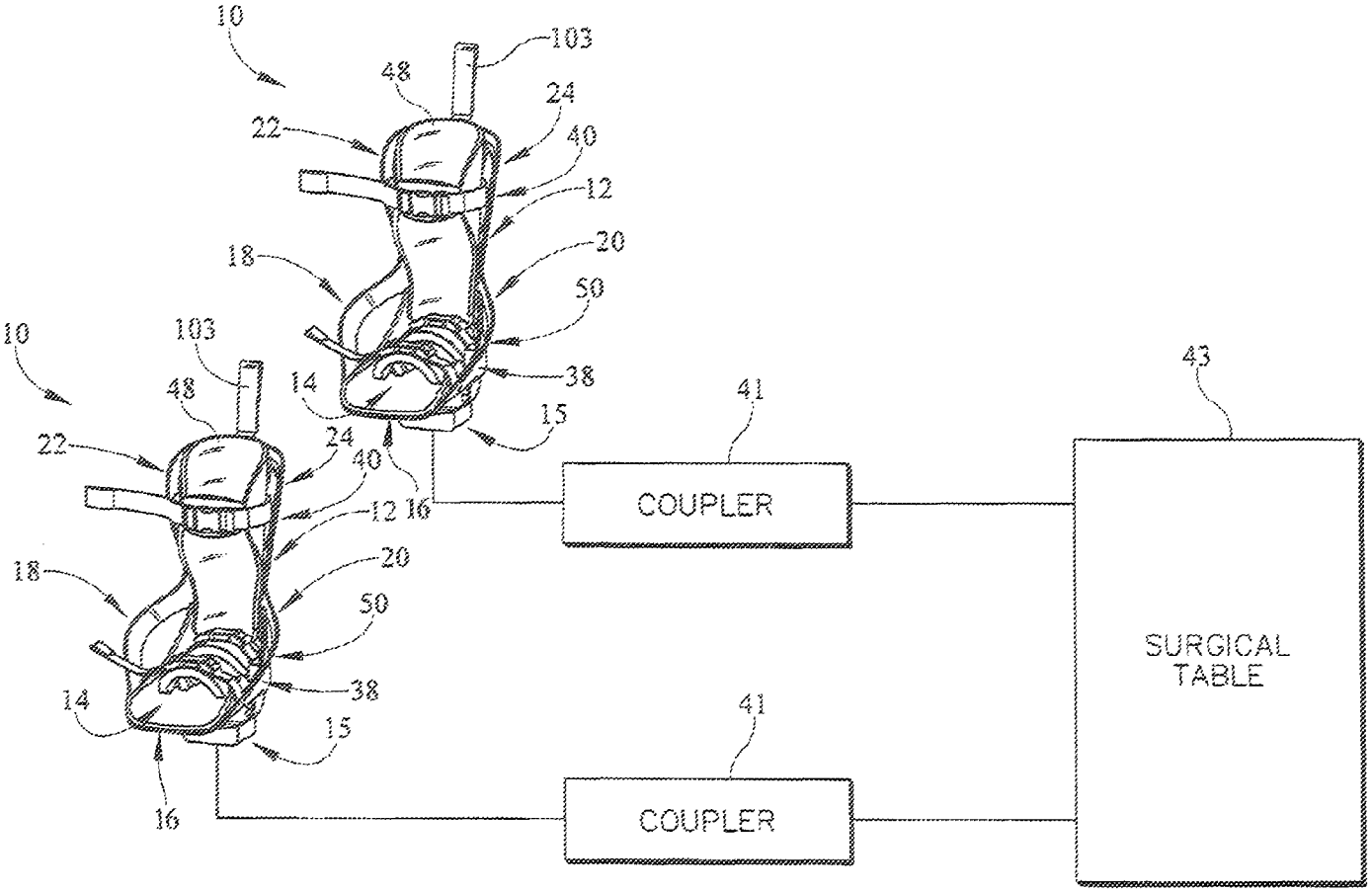
FIG. 9 is a partially diagrammatic view of a surgical table with a pair of couplers each secured to a surgical boot suggesting that the surgical boot is configured for use in a surgical setting and adapted to be supported by a surgical table.

In one illustrative embodiment, a surgical foot support is embodied as a surgical boot 10 including a shell 12 providing support structure for the surgical boot 10, a securing system 14, a quick disconnect receiver 15 coupled to shell 12, and a tightener system 50 for tightening and retaining a patient's foot in surgical boot 10 as shown in FIG. 6. Shell 12 includes a main body 16 and a plurality of handles 18, 20, 22, 24 sized and arranged for gripping by a caregiver during surgery to reposition a patient's foot and/or leg, for example when a caregiver is distracting a patient's hip joint or performing surgery on the patient's leg as shown in FIG. 1. Securing system 14 is configured to couple a patient's foot and lower leg to shell 12 of the surgical boot 10 as shown in FIG. 5. Quick disconnect receiver 15 is configured to couple surgical boot 10 to another surgical support as shown diagrammatically in FIG. 9. Tightener system 50 is configured to tighten a patient's foot with shell 12 and to retain a patient's foot in surgical boot 10 during repositioning of a patient's foot as shown in FIG. 6.

Shell 12 includes a sole 25 configured to underlie a patient's foot and a calf support 26 configured to support the lower leg of a patient as suggested in FIG. 1. Shell 12 has a toe end 28, a heel end 30, a left side 32, and a right side 34. Main body 16 of shell 12 forms an upwardly-facing channel 36 that opens along sole 25 as shown, for example, in FIG. 1. A patient's foot may be lowered into upwardly-facing channel 36 of surgical boot 10 without bending the patient's foot relative to the lower leg of the patient as suggested by arrow 36L in FIG. 4. Calf support 26 is coupled to sole 25 and extends up from sole 25 near heel end 30 of shell 12.

Tightener system 50 includes a main strap assembly 52 configured to extend over a patient's foot in front of the patient's ankle, a tensioner unit 53 coupled to shell 12, a heel strap assembly 54 configured to extend around a back side of a patient's foot above the patient's heel bone, and a strap guide assembly 56 for guiding main strap assembly 52 from the sides 32, 34 of shell 12 to the heel end 30 of shell 12 as shown in FIG. 6. Main strap assembly 52 is configured to be pulled down toward sole 25 of shell 12 to tighten a patient's foot with shell 12 as suggested by arrow 52T in FIG. 6. Tensioner unit 53 is configured to be operated by a caregiver to pull main strap assembly 52 over a patient's foot down toward sole 25 of shell 12 as shown in FIG. 6. Heel strap assembly 54 is coupled to main strap assembly 52 and blocks a patient's heel from lifting up from sole 25 when a caregiver is repositioning a patient foot so that the patient's foot is retained in surgical boot 10. Strap guide assembly 56 cooperates with a rear guide beam 110 included in shell 12 to guide main strap assembly 52 from over a patient's foot to the tensioner unit 53.

Figure 2:
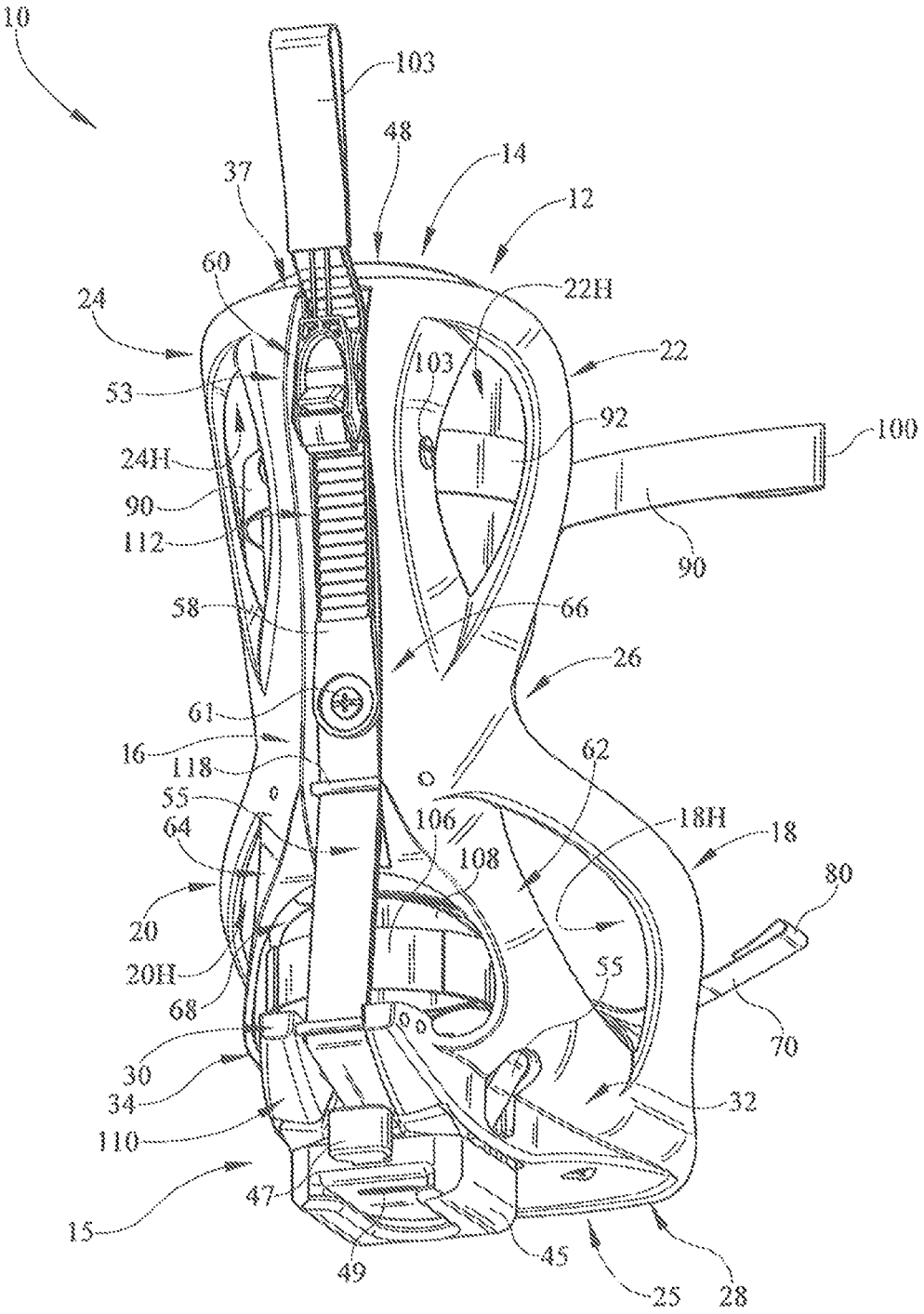
FIG. 2 is a rear perspective view of the surgical boot of FIG. 1 showing that the surgical boot includes a tensioner unit coupled to a back side of the shell for tightening a patient's foot with the shell by pulling a main strap assembly down toward the shell as shown in FIG. 6.
Figure 3:
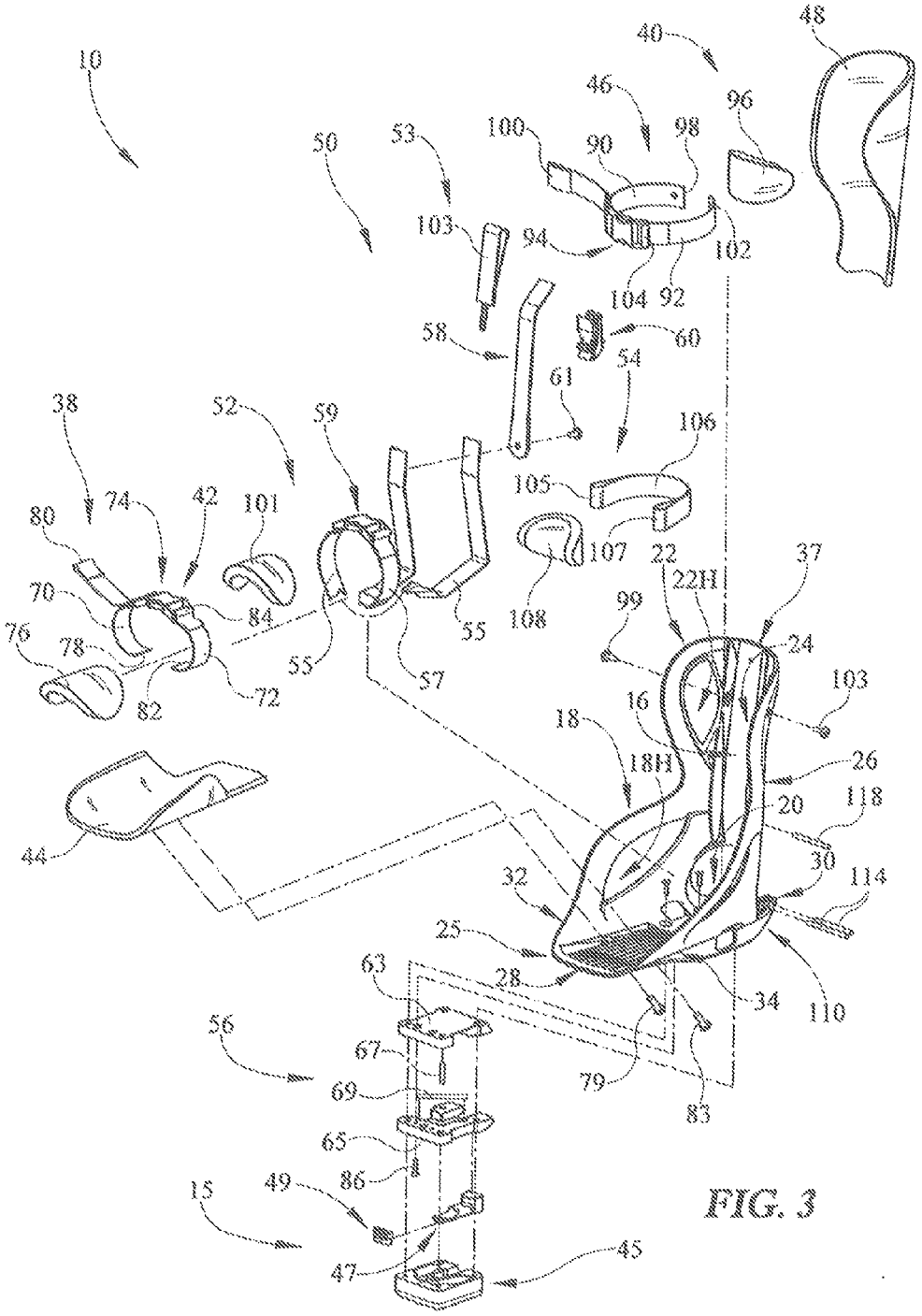
FIG. 3 is an exploded front perspective view of the surgical boot of FIGS. 1 and 2 showing that the surgical boot includes a toe strap assembly that extends over a patient's foot near a toe end of the shell, the main strap assembly that extends over a patient's foot near a heel end of the shell, a heel strap assembly that extends around the back side of a patient's foot above a patient's heel bone, and a calf strap assembly that extends over a front side of patient's lower leg.
Figure 4:
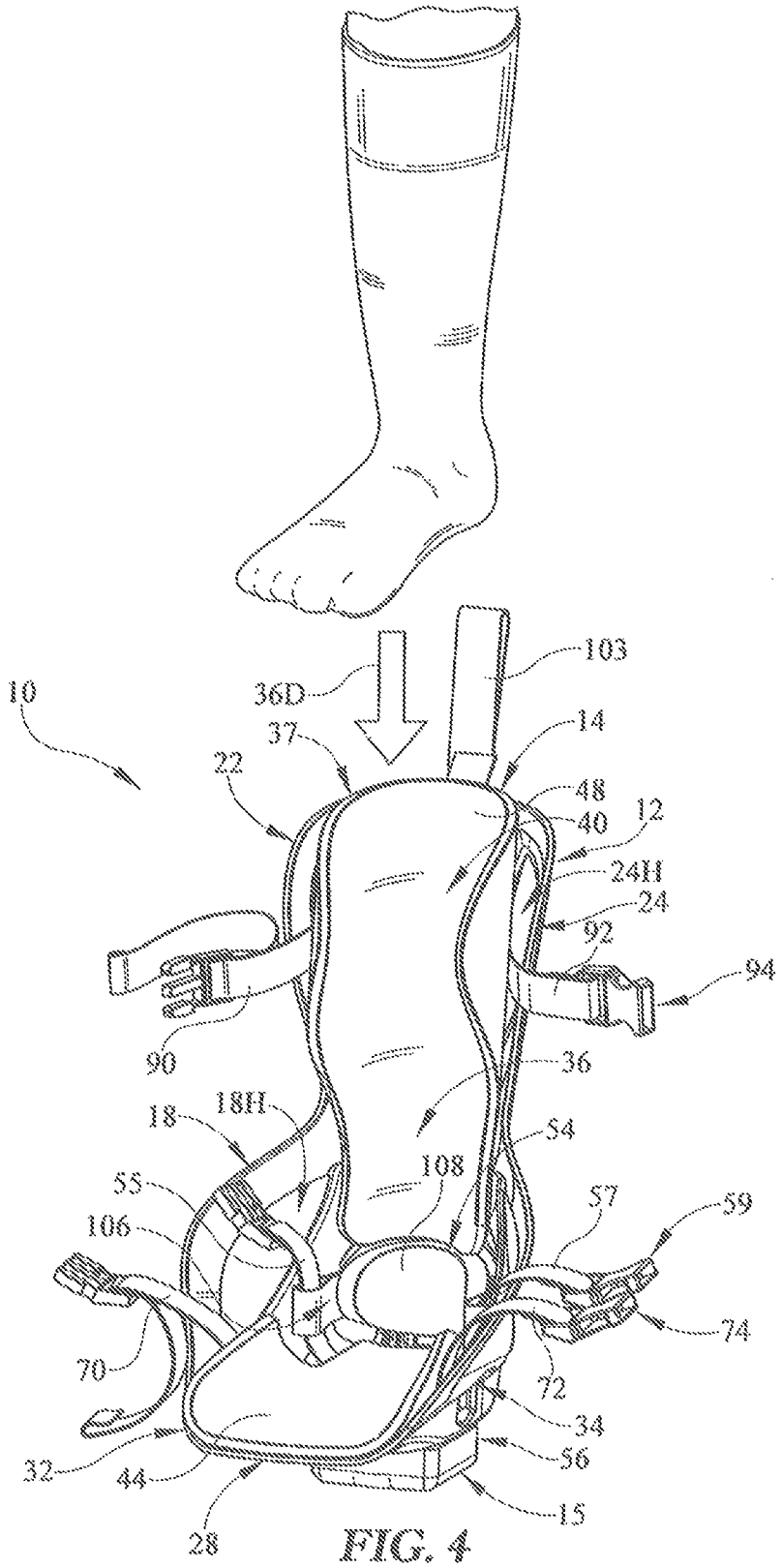
FIG. 4 is a front perspective view of the surgical boot of FIG. 1 showing buckles of the toe strap assembly, the main strap assembly, and the calf strap assembly opened so that a patient's foot can be lowered into a channel formed by the shell.

Main strap assembly 52 includes a left strap 55, a right strap 57, a foot pad 101, and a buckle 59 for securing left strap 55 to right strap 57 of main strap assembly 52 over a patient's foot as shown in FIG. 3. Buckle 59 is movable between an open configuration allowing a patient's foot to be lowered into channel 36 of surgical boot 10, as shown in FIG. 4, and a closed configuration blocking a patient's foot from being lifted out of channel 36 of surgical boot 10 as shown in FIG. 5. Foot pad 101 is situated between buckle 59 and a patient's foot when main strap assembly 52 extends over the patient's foot as suggested in FIG. 1. Left strap 55 and right strap 57 of main strap assembly 52 extend through left side 32 and right side 34 of surgical boot 10, respectively, and are both secured to toothed belt 58 by a fastener 61 as shown in FIGS. 2 and 3.

Tensioner unit 53 is illustratively coupled along heel end, or back side, 30 of calf support 26 and includes a toothed belt 58, a ratchet 60, and a locator handle 103 as shown, for example, in FIG. 3. In other embodiments, tensioner unit 53 may be coupled to a bottom side 39 of sole 25. Toothed belt 58 is coupled to main strap assembly 52 by a fastener 61 as shown in FIG. 3. Ratchet 60 is coupled to calf support 26 of shell 12 and is configured to advance toothed belt 58 in a forward direction indicated by an arrow 58F in FIG. 6 to pull main strap assembly 52 down toward sole 25 of shell 12. Locator handle 103 is coupled to ratchet 60 and is configured to hang down from ratchet 60 so that a caregiver can tactilely locate and/or operate ratchet 60 during a surgery. In other embodiments, other tightening devices such as reels, worm gears, gear sets, or motors may be used to pull main strap assembly 52.

Figure 7:
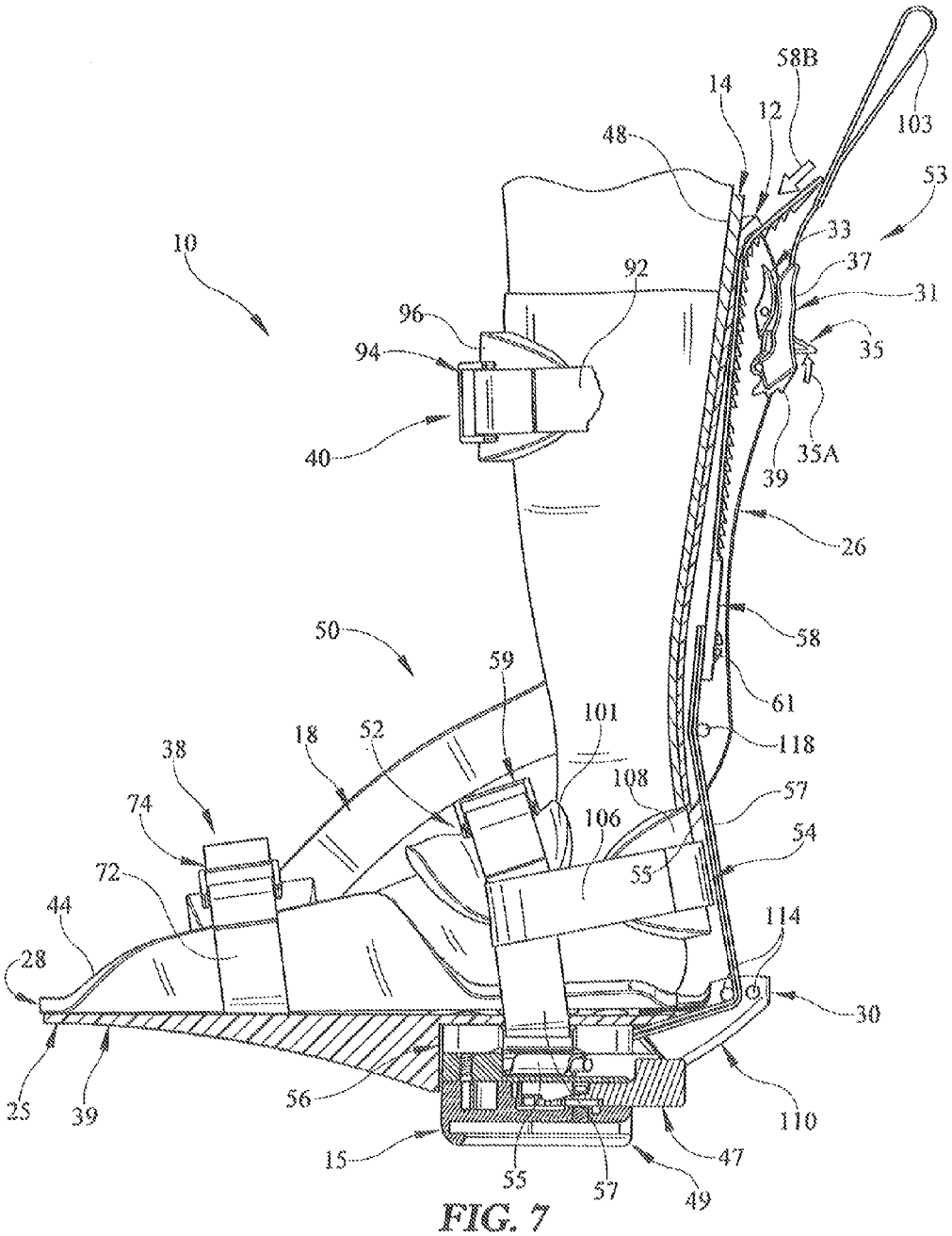
FIG. 7 is a partially cutaway side elevation view of the surgical boot of FIG. 6 showing the main strap assembly being loosened when the tensioner unit is disengaged in response to a release lever being operated by a caregiver.

Ratchet 60 illustratively includes an actuator handle 31, a keeper pawl 33, and a release lever 35 as shown, for example, in FIG. 6. Actuator handle 31 includes an actuator lever 37 and a ratchet pawl 39. Actuator handle 31 is illustratively operated by a caregiver pivoting actuator lever 37 as suggested by arrow 31A in FIG. 6 so that ratchet pawl 39 advances toothed belt 58 through ratchet 60. Keeper pawl 33 is configured to block toothed belt 58 from moving backward through ratchet 60 while actuator handle 31 advances toothed belt 58. Release lever 35 is configured to be operated by a caregiver pivoting release lever 35, as suggested by arrow 35A in FIG. 7, so that keeper pawl 33 and ratchet pawl 39 are moved out of engagement with toothed belt 58 thereby allowing toothed belt 58 to move backward through ratchet 60 as suggested by arrow 58B in FIG. 7.

Heel strap assembly 54 includes a strap 106 and a heel pad 108 as shown in FIG. 3. Strap 106 is slidably coupled at a first end 105 to left strap 55 of main strap assembly 52 and at a second end 107 to right strap 57 of main strap assembly 52 as suggested in FIG. 3. Heel pad 108 is situated between strap 106 and a patient's heel to cushion the patient's heel as suggested in FIG. 2. When a patient's foot is secured in surgical boot 10, main strap assembly 52 and heel strap assembly 54 cooperate to extend around a patient's ankle and to retain a patient's heel in surgical boot 10 during repositioning of the patient's foot by a caregiver.

Figure 8:
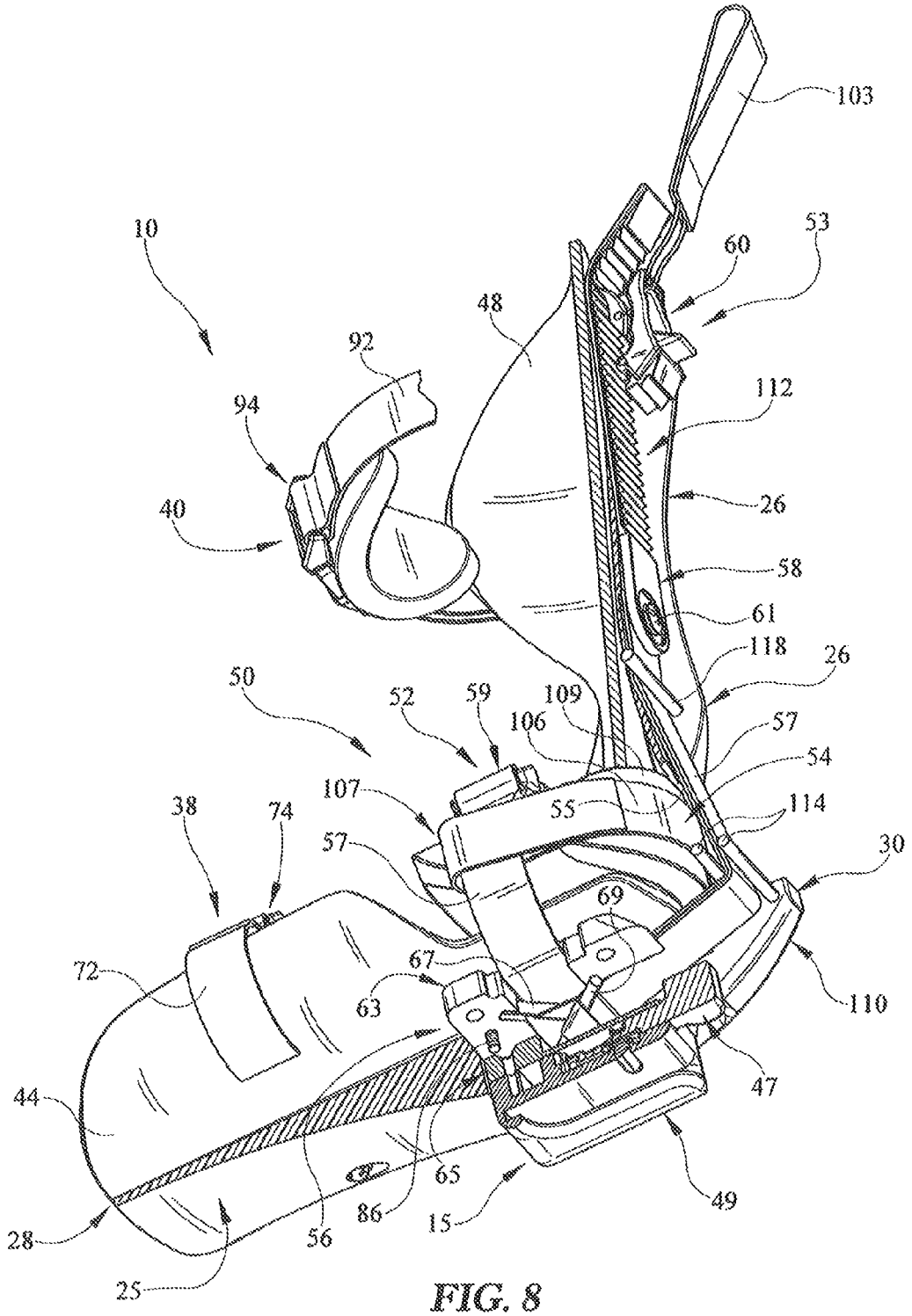
FIG. 8 is a partially cutaway bottom perspective view of the surgical boot of FIG. 1 showing that the surgical boot includes a strap guide assembly coupled to the bottom of the surgical boot and configured to direct a left strap and a right strap of the main strap assembly from the sides of the surgical boot back toward the heel end of the surgical boot.

Strap guide assembly 56 receives left and right straps 55, 57 of main strap assembly 52 from left and right sides 32, 34 of shell 12 and redirects left and right straps 55, 57 out from strap guide assembly 56 toward heel end 30 of shell 12 as shown in FIG. 8. Strap guide assembly 56 is coupled to sole 25 of shell 12 between sole 25 and quick disconnect receiver 1. Strap guide assembly 56 includes a top plate 63, a bottom plate 65, a top guide pin 67, and a bottom guide pin 69.

Top guide pin 67 is supported by top plate 63 and engages right strap 57 of main strap assembly 52 to direct right strap 57 from the right side 34 of shell 12 back toward heel end 30 of shell 12 as shown in FIG. 8. Bottom guide pin 69 is supported by bottom plate 65 and engages left strap 55 of main strap assembly 52 to direct left strap 55 from the left side 32 of shell 12 back toward heel end 30 of shell 12. Guide pins 67, 69 are oriented to form an X-shape with each guide pin 67, 69 angled about forty-five degrees from an axis extending from the toe end 28 to the heel end 30 of shell 12. Top plate 63 is coupled to bottom plate 65 by fasteners 86, as shown in FIG. 3.

Rear guide beam 110 included in shell 12 forms heel end 30 of shell 12 arranged behind the calf support 26 as shown in FIG. 6. Calf support 26 of shell 12 is formed to include a channel 112 for guiding left and right straps 55, 57 of main strap assembly 52 and toothed belt 58 along calf support 26 as shown in FIG. 2. Rear guide beam 110 directs main strap assembly 52 from heel end 30 of shell 12 up along channel 112 formed in calf support 26. Rear guide beam 110 includes a pair of beam guide pins 114 as shown in FIGS. 3 and 6 for engaging and directing left and right straps 55, 57 of main strap assembly 52. Surgical boot 10 also includes a channel guide pin 118 as shown in FIGS. 2 and 3 for holding left and right straps 55, 57 of main strap assembly 52 in position relative to channel 112 along calf support 26.

Plurality of handles 18, 20, 22, 24 is made up of lower left handle 18, lower right handle 20, upper left handle 22, and upper right handle 24 as shown in FIG. 1. In the illustrative embodiment, shell 12 is made from a monolithic plastics material and thus each of the plurality of handles 18, 20, 22, 24 is integrally formed with main body 16 of shell 12. Illustratively, shell 12 may be made from an ABS polycarbonate blended material. Further, the plurality of handles 18, 20, 22, 24 have a thickness similar to a thickness of main body 16 as shown in FIG. 1. Illustratively, the handles 18, 20, 22, 24 and the main body 16 have a thickness of about 0.2 inches. In other embodiments, other thicknesses of shell 12 may be used.

Lower left handle 18 and lower right handle 20 extend from calf support 26 near heel end 30 of shell 12 to sole 25 near toe end 28 of shell 12 so that lower left and lower right handles 18, 20 are arranged to extend along the length of a patient's foot as suggested in FIG. 2. Lower left handle 18 and lower right handle 20 form corresponding lower handhold openings 18H, 20H that extend through shell 12. Lower handhold openings 18H, 20H are sized to allow a caregiver's hand to pass through shell 12. Lower left handle 18 and lower right handle 20 are arcuate and extend away from channel 36 of main body 16 along left side 32 of shell 12 and right side 34 of shell 12, respectively, so that a caregiver can grip lower left handle 18 and lower right handle 20 with a portion of his hand situated between a patient's foot and shell 12.

Upper left handle 22 and upper right handle 24 are arcuate and extend away from channel 36 along calf support 26 from a top end 37 of calf support 26 down toward sole 25 of shell 12 so that upper left and upper right handles 22, 24 are arranged to extend along the length of a patient's lower leg as suggested in FIG. 1. Upper left handle 22 and upper right handle 24 form corresponding handhold openings 22H and 24H that extend through shell 12. Upper handhold openings 22H, 24H are sized to allow a caregiver's hand to pass through shell 12. Upper left handle 22 and upper right handle 24 are arcuate and extend away from channel 36 of main body 16 along left side 32 of shell 12 and right side 34 of shell 12, respectively, so that a caregiver can grip upper left handle 22 and upper right handle 24 with a portion of his hand situated between a patient's lower leg and shell 12.

Securing system 14 is configured to couple a patient's foot and lower leg to shell 12 of the surgical boot 10 and includes a foot securing system 38 and a calf securing system 40 as shown in FIG. 1. Foot securing system 38 is configured to couple a patient's foot to sole 25 of shell 12 and illustratively includes a toe strap assembly 42 and a sole pad 44 as shown in FIGS. 1 and 3. Sole pad 44 is coupled to sole 25 of shell 12 to cushion a patient's foot when a patient is secured to surgical boot 10 as suggested in FIG. 1. Calf securing system 40 is configured to couple a patient's lower leg to calf support 26 of shell 12 and illustratively includes leg strap assembly 46 and a calf pad 48 as shown in FIGS. 1 and 3. Calf pad 48 is coupled to calf support 26 of shell 12 to cushion a patient's lower leg when a patient is secured to surgical boot 10 as suggested in FIG. 1.

Quick disconnect receiver 15 is illustratively coupled to a bottom side 39 of sole 25 and extends downwardly from sole 25 as shown in FIG. 2. Quick disconnect receiver 15 is configured to couple to a coupler 41 attached to a surgical table 43 as shown diagrammatically in FIG. 4. In the illustrative embodiment, quick disconnect receiver 15 includes a receiver body 45, a release handle 47, and a retainer lug 49 as shown, for example, in FIG. 3. Retainer lug 49 is configured to engage coupler 41 when quick disconnect receiver 15 is coupled to coupler 41. Release handle 47 is configured to disengage retainer lug 49 from coupler 41 so that surgical boot 10 can be moved away from coupler 41.

Coupler 41 may include one or more of a handle, a post, a spar, a clamp, and a carriage as is known in the art. In some embodiments, quick disconnect receiver 15 may be movably coupled to coupler 41 so that a caregiver can position surgical boot 10 at different positions along coupler 41. In some embodiments, quick disconnect receiver 15 may be configured to couple directly to surgical table 43. Quick disconnect receiver 15 allows surgical boot 10 to be positioned for surgery, traction, and other applications of the surgical boot 10.

Calf support 26 includes a left leg 62, a right leg 64, and a calf plate 66 supported near heel end 30 of shell 12 as shown in FIG. 2. Left leg 62 and right leg 64 extend up from sole 25 along left and right sides 32, 34 of shell 12 and support calf plate 66. Left leg 62, right leg 64, and calf plate 66 cooperate to form an opening 68 between sole 25 and calf plate 66 near heel end 30 of shell 12.

Toe strap assembly 42 of foot securing system 38 is configured to extend across a patient's foot near the toe end 28 shell 12 when a patient is secured to surgical boot 10 as shown, for example, in FIG. 5. Toe strap assembly 42 includes a left strap 70, a right strap 72, a buckle 74, and a toe pad 76 as shown in FIG. 3. Left strap 70 of toe strap assembly 42 has a first end 78 coupled to left side 32 of shell 12 by a fastener 79 and a second end 80. Right strap 72 of toe strap assembly 42 has a first end 82 coupled to right side 34 of shell 12 by a fastener 83 and a second end 84 coupled to buckle 74. Buckle 74 of toe strap assembly 42 is configured to move between an open configuration allowing a patient's foot from being lifted out of channel 36 of surgical boot 10 and a closed configuration blocking a patient from lifting his foot out of channel 36. Buckle 74 is slidably coupled to left strap 70 so that toe strap assembly 42 may be tightened or loosened over a patient's foot by a caregiver. Toe pad 76 is situated between buckle 74 and a patient's foot to cushion a patient's foot when toe strap assembly 42 extends over a patient's foot as shown in FIG. 1.

Leg strap assembly 46 of calf securing system 40 is configured to extend over a patient's lower leg near the top end 37 of calf support 26 when a patient is secured to surgical boot 10 as suggested in FIG. 5. Leg strap assembly 46 includes a left strap 90, a right strap 92, a buckle 94, and a leg pad 96 as shown, for example, in FIG. 3. Left strap 90 of leg strap assembly 46 has a first end 98 coupled to calf plate 66 by a fastener 99 and a second end 100. Right strap 92 of leg strap assembly 46 has a first end 102 coupled to calf plate 66 by a fastener 105 and a second end 104. Buckle 94 of leg strap assembly 46 is configured to move between an open configuration allowing a patient's lower leg to be lowered into channel 36 of surgical boot 10 and a closed configuration blocking a patient's lower leg from being lifted out of channel 36 of surgical boot 10. Buckle 94 is slidably coupled to left strap 90 so that leg strap assembly 46 may be tightened or loosened over a patient's lower leg by a caregiver. Leg pad 96 is situated between buckle 94 and the patient's lower leg to cushion a patient's lower leg when leg strap assembly 46 extends over a patient's lower leg as shown in FIG. 1.

In illustrative operation, a caregiver moves buckle 59 of main strap assembly 52, buckle 74 of toe strap assembly 42, and buckle 94 of leg strap assembly 46 to the open position to allow a patient's foot to be lowered into channel 36 of surgical boot 10 as shown in FIG. 4. A caregiver places a patient's foot into channel 36 of surgical boot 10. A caregiver guides straps included in toe strap assembly 42, leg strap assembly 46, main strap assembly 52, and heel strap assembly 54 over a patient's foot and lower leg. A caregiver moves buckle 59 of main strap assembly 52, buckle 74 of toe strap assembly 42, and buckle 94 of leg strap assembly 46 to the closed position to block the patient's foot from being removed from surgical boot 10 as shown in FIG. 5. Then the caregiver operates ratchet 60 of tensioner unit 53 to advance toothed belt 58 through ratchet 60 thereby pulling main strap assembly 52 down over a patient's foot so that a patient's foot is tightened with shell 12 of surgical boot 10. The caregiver may then couple quick disconnect receiver 15 with coupler 41 to support surgical boot 10 at a location or for movement along coupler 41. A caregiver may then manipulate the position or arrangement of the patient by gripping one or more of the plurality of handles 18, 20, 22, 24. During repositioning of the patient's foot, heel strap 54 is configured to engage the back side of a patient's foot above the heel bone to hold the patient's heel in contact with shell 12 of surgical boot 10 resisting movement of the patient's foot relative to shell 12.

Figure 10:
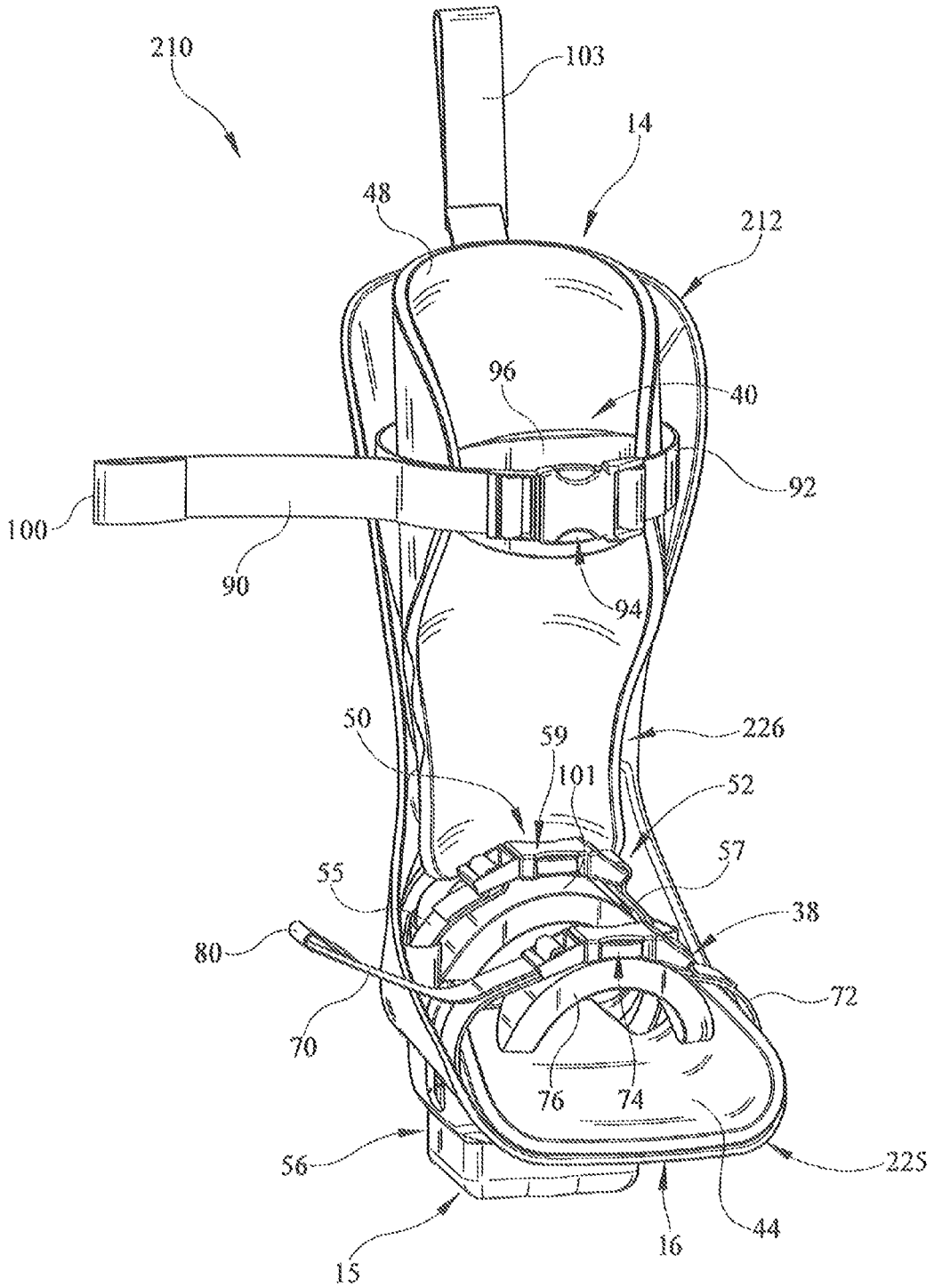
FIG. 10 is a front perspective view of another surgical boot similar to the surgical boot of FIG. 1 showing that the surgical boot includes a shell without handles, several straps for securing a patient's foot and lower leg to the shell, and a receiver coupled to the bottom of the shell.
Figure 11:
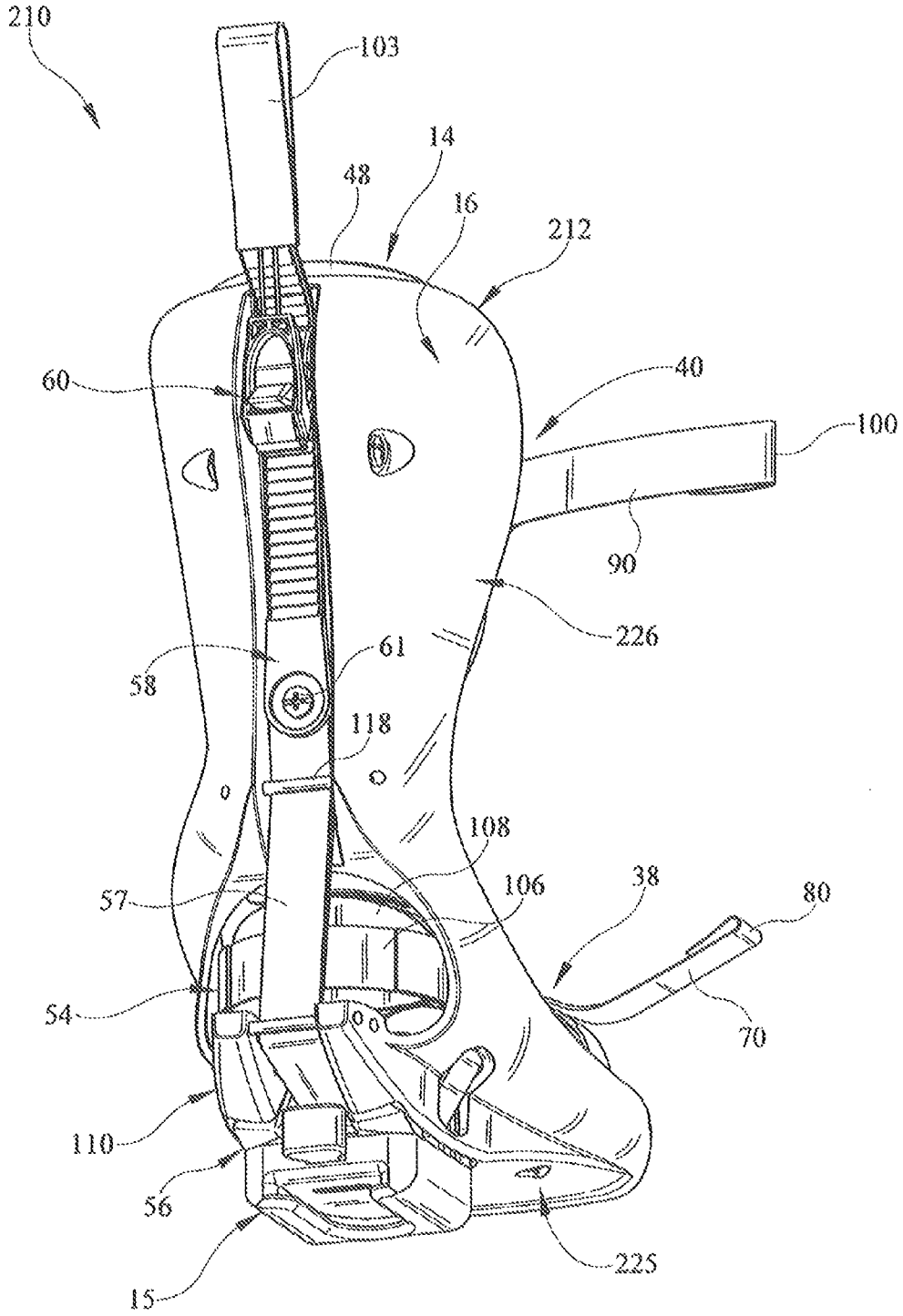
FIG. 11 is a rear perspective view of the surgical boot of FIG. 10 showing that the surgical boot includes a tensioner unit coupled to a back side of the shell for tightening a patient's foot with the shell by pulling a main strap assembly down toward the shell.

Another surgical boot 210 is shown in FIGS. 10 and 11. Surgical boot 210 is similar to surgical boot 10 shown in FIGS. 1-10 and like reference numerals are used to denote similar parts. However, surgical boot 210 includes a shell 212 formed to include a sole 225 and a calf support 226 without handles as shown in FIGS. 10 and 11 thereby leaving the sides of shell 212 open so that a caregiver can access a patient's foot or lower leg from the side. In some embodiments, surgical boot 210 may be used with other surgical supports including mechanical devices for moving surgical boot 210 in order to distract a patient's hip joint or perform surgery on the patient's leg.

Although certain illustrative embodiments have been described in detail above, variations and modifications exist within the scope and spirit of this disclosure as described and as defined in the following claims.

The invention claimed is:

1. A surgical boot comprising a shell shaped to receive a patient's foot, a main strap assembly including at least one strap that secures a patient's foot in the shell, a tensioner unit located behind a heel end of the shell configured to pull a strap that secures a patient's foot in the shell downwardly from above a patient's foot received in the shell toward a sole of the shell arranged to underlie a patient's foot received in the shell to tighten a patient's foot within the shell, and a strap guide assembly configured to receive a strap that secures a patient's foot in the shell from along a left or a right side of the shell and to redirect the strap toward the heel end of the shell, the strap guide assembly coupled to the sole formed by the shell and arranged to extend downwardly from the sole.

2. The surgical boot of claim 1, wherein the tensioner unit includes a ratchet and a toothed belt coupled to the at least one strap, the toothed belt configured to be advanced in a forward direction through the ratchet to pull the at least one strap of the main strap assembly.

3. The surgical boot of claim 2, wherein the ratchet includes an actuator lever operable by a caregiver to advance the toothed belt through the ratchet and a release lever configured to selectively release the toothed belt from the ratchet so that the toothed belt is free to move in a backward direction through the ratchet.

4. The surgical boot of claim 3, wherein the ratchet includes a ratchet pawl engaging the toothed belt to advance the toothed belt in a forward direction and a keeper pawl configured to engage the toothed belt and block the toothed belt from moving in the backward direction.

5. The surgical boot of claim 1, wherein the at least one strap extends across an upwardly-facing channel formed by the shell and through a left and a right side of the shell.

6. The surgical boot of claim 5, wherein the strap guide assembly is configured to guide a first strap and a second strap included in the main strap assembly from left and right sides of the shell toward a heel end of the shell.

7. The surgical boot of claim 6, wherein the strap guide assembly is coupled directly to a bottom side of the sole.

8. The surgical boot of claim 1, further comprising a heel strap assembly configured to extend around the back side of a patient's foot over a patient's heel bone.

9. The surgical boot of claim 8, wherein the heel strap has a first end coupled directly to a first strap of the main strap assembly and a second end coupled directly to a second strap of the main strap assembly.

10. The surgical boot of claim 9, wherein the first end of the heel strap is coupled directly to the first strap of the main strap assembly to slide relative to the first strap of the main strap assembly and the second end of the heel strap is coupled directly to the second strap of the main strap assembly to slide relative to the second strap of the main strap assembly.

11. A surgical boot comprising a shell formed to define a channel sized to receive a patient's foot, the shell including a sole and a calf support, a main strap assembly configured to extend over a patient's foot near a patient's lower leg, a heel strap assembly arranged in the channel formed by the shell and having a first end coupled directly to the main strap assembly and a second end coupled directly to the main strap assembly, the heel strap assembly configured to extend around the back side of a patient's foot above a patient's heel bone, and a tensioner unit configured to pull the main strap assembly toward the sole of the shell to tighten a patient's foot within the shell.

12. The surgical boot of claim 11, wherein the main strap assembly includes a left strap and a right strap.

13. The surgical boot of claim 12, wherein the tensioner unit includes a ratchet and a toothed belt coupled to the left strap and the right strap.

14. The surgical boot of claim 12, wherein the left strap and the right strap extend through the shell.

15. The surgical boot of claim 11, wherein the first end and the second end of the heel strap assembly are coupled directly to the main strap assembly to slide relative to the main strap assembly.

16. The surgical boot of claim 11, further comprising a receiver configured to couple the surgical boot to a surgical table.

17. A surgical boot comprising a shell shaped to receive a patient's foot and a main strap assembly including at least one strap that secures a patient's foot in the shell and that is pulled downwardly by a tensioner unit located behind the shell to tighten a patient's foot within the shell, wherein the shell has a toe end and a heel end, the shell including a sole, a calf support extending up from the sole near the heel end of the shell, and a rear guide beam situated behind the calf support and forming the heel end of the shell, the rear guide beam configured to guide a first strap and a second strap included in the main strap assembly from below the sole toward the calf support.

18. The surgical boot of claim 17, wherein the calf support is formed to include a guide channel configured to receive and guide the first strap and the second strap included in the main strap assembly along a heel-end side of the calf support.

19. A method for securing a patient's foot in a surgical boot, the method comprising the steps of placing a patient's foot in a channel formed by a shell of the surgical boot, guiding a first strap and a second strap across the patient's foot near a patient's ankle, coupling the first strap to the second strap, and operating a tensioner unit coupled to a back side of a calf support included in the shell to pull the first strap and the second strap down through the shell toward a sole of the shell arranged to underlie a patient's foot received in the shell so that a patient's foot is tightened within the shell, wherein the surgical boot includes a heel strap having a first end coupled directly to the first strap and a second end coupled directly to the second strap, the heel strap configured to extend around the back side of a patient's foot above the heel bone.

20. The method of claim 19, wherein the first end of the heel strap is coupled directly to the first strap of the main strap assembly to slide along the first strap of the main strap assembly and the second end of the heel strap is coupled directly to the second strap of the main strap assembly to slide along the second strap of the main strap assembly.

* * * * *